United States Patent [19]

Gondo et al.

[11] 4,087,289

[45] May 2, 1978

[54] ANTI-VIBRATION STEEL MATERIAL AND A PRODUCTION METHOD THEREFOR

[75] Inventors: Hisashi Gondo; Mitsunobu Abe; Matsuo Usuda, all of Kisarazu; Kunihiko Komiya, Kimitsu; Tsuyoshi Kawano, Kisarazu, all of Japan

[73] Assignee: Nippon Steel Corporation, Japan

[21] Appl. No.: 781,000

[22] Filed: Mar. 24, 1977

[30] Foreign Application Priority Data

Mar. 27, 1976 Japan ..... 51-33102

[51] Int. Cl.[2] ..... C21D 7/02

[52] U.S. Cl. ..... 148/12 R; 148/12 C; 148/36

[58] Field of Search ..... 148/12 R, 12 C, 36; 75/123 R

[56] References Cited

U.S. PATENT DOCUMENTS 3,865,637 2/1975 Matusdo et al. ..... 148/12 C 3,947,294 3/1976 Asamura et al. ..... 148/12 C 3,950,190 4/1976 Lake ..... 148/12 R

*Primary Examiner*—W. Stallard

*Attorney, Agent, or Firm*—Wenderoth, Lind & Ponack

[57] ABSTRACT

Anti-vibration steel materials containing not more than 0.1% of carbon and not more than 0.5% of manganese and having an $\alpha$ value of not lower than 55, said value being a product of the yield point or stress at 0.2% strain and the grain size number, and a method for producing the same which comprises hot rolling a steel slab, billet or bloom containing not more than 0.1% of carbon, not more than 0.5% of manganese, giving not more than 10% of strain to the hot rolled steel, annealing the hot rolled steel thus strain given at a temperature not lower than its recrystallization temperature but not higher than its $A_3$ transformation point for at least one minute and controlling the $\alpha$ value as defined herein to a value not more than 55.

7 Claims, 1 Drawing Figure

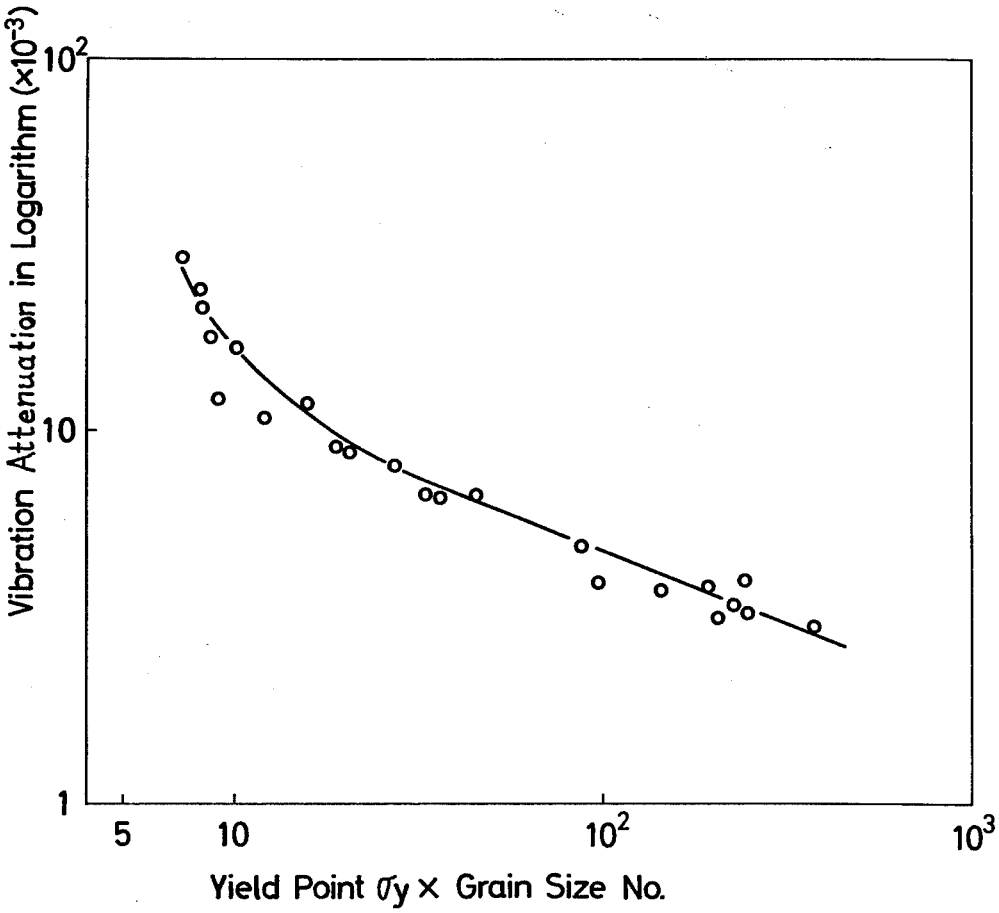
Vibration Attenuation in Logarithm (×10⁻³)
10²
10
1
5
10
10²
10³
Yield Point σy × Grain Size No.

ANTI-VIBRATION STEEL MATERIAL AND A PRODUCTION METHOD THEREFOR

BACKGROUND OF THE INVENTION

1. Field of the Invention

The present invention relates to a vibration attenuating and sound suppressing steel material useful for panels, ducts, automobiles, trains and electrical appliance and other structural members which produce vibrations and sounds.

2. Description of Prior Art

In recent years, traffic sounds and plant sounds have been treated as a social problem of public pollution, various sound preventive devices and equipments such as sound suppressing walls have been proposed and actually in service from view points of sound absorption and sound shielding.

Further, in case where sounds are radiated by the vibration of the structure itself, sound prevention means have been proposed by applying anti-vibration treatments to the steel structure such as coating of anti-vibration paint, rubber and plastics, for example.

On the other hand, some materials, such as manganese-copper alloys and flake-graphite cast iron have been proposed for providing anti-vibration property to the structural components themselves. However, the manganese-copper alloys have a defect that their anti-vibration function deteriorates at temperatures 500° C or higher, and their workability and weldability are poor. Also the flake-graphite cast iron has a very poor workability and weldability.

Vibration attenuating or damping alloys have been developed and disclosed, for example in Japanese Patent Publications Sho 52-803, Sho 52-804 and Sho 52-1683, but these alloys are also confronted with the problems of poor workability and weldability as well as high production cost due to a large amount of special alloy elements such as Cr and Al used.

SUMMARY OF THE INVENTION

Therefore, one of the objects of the present invention is to provide a common place steel material having satisfactory anti-vibration property as well as good workability and weldability at a relatively low production cost.

Another object of the present invention is to provide a steel material effective for vibration attenuation and sound suppressing.

Further another object of the present invention is to provide a method for producing the above steel material by enlarging the grain size and lowering the yield point.

Other objects of the present invention will be clear from the following descriptions referring to the attached drawings.

The features of the present invention may be summarized below:

1. An anti-vibration steel material according to the present invention contains not more than 0.1% of carbon, not more than 0.5% of manganese with unavoidable impurities with the balance being iron, and shows a logarithmic attenuation of not less than 0.006 when given a vibration of 0.01% surfacial strain, and shows $\alpha$ value of not more than 55 in the following formula:

$$\alpha = \sigma_y \times N$$

where $\sigma_y$ : yield point or stress (kg/mm$^2$) at 0.2% strain

N : grain size number $$N = 1 + \frac{1}{0.301} \log\left\{ 500 \left(\frac{M}{100}\right)^2 \left(\frac{n_1 \times n_2}{L_1 \times L_2}\right) \right\}$$

M : observation magnification $L_1$ ($L_2$) : the total (mm) of lengths of line components in one direction of line components crossing each other at right angle $n_1$ ($n_2$) : the total number of the number of grains cut by $L_1$ ($L_2$)

(according to JIS G-0552)

2. The method for producing the anti-vibration steel material according to the present invention comprises hot rolling a steel slab, billet or bloom containing not more than 0.1% of carbon and not more than 0.5% of manganese, giving the slab, billet or bloom a strain not more than 10%, annealing the slab billet or bloom at temperature in the range from its recrystallization temperature and its $A_3$ transformation point for not shorter than 1 minute to obtain the $\alpha$ value defined above of not more than 55.

3. A modification of the method according to the present invention comprises hot rolling a steel slab containing not more than 0.1% of carbon and not more than 0.5% of manganese, cold rolling the hot rolled steel slab, annealing the cold rolled steel sheet at a temperature in a range from its recrystallization temperature to its $A_3$ transformation point for not shorter than 40 seconds, giving the steel sheet a strain of not more than 10%, and annealing the steel sheet at a temperature in a range from its recrystallization temperature to its $A_3$ transformation point so as to maintain the $\alpha$ value defined above at 55 or lower.

4. In another modification of the method according to the present invention, a vacuum degassed steel with a lowered carbon content of not more than 0.01% is used as the starting material.

DETAILED DESCRIPTION OF THE INVENTION

The present invention will be described in more detail referring to the attached drawing in connection with a steel sheet.

BRIEF DESCRIPTION OF THE DRAWING

FIG. 1 shows the relation between the $\alpha$ value (yield point $\sigma_y \times$ grain size number N) and the logarithmic attenuation when given vibration of 0.01% surfacial strain.

The basic characteristics required for an anti-vibration steel sheet are that vibration of the steel sheet when hammered and vibration attenuation is large.

For expressing the above basic characteristic the logarithmic vibration attenuation is widely known and used, and a larger attenuation indicates a better anti-vibration characteristics.

FIG. 1 shows the logarithmic vibration attenuation, namely the anti-vibration property of a steel sheet when given vibration of 0.01% surfacial strain in correspondence to a wide variation of the $\alpha$ value as defined hereinbefore. When the $\alpha$ value is not larger than 55, the logarithmic attenuation is 0.006 or more, which indicates anti-vibration property two or more times better than that of an ordinary cold rolled steel sheet, and when the $\alpha$ value is not larger than 34, the anti-vibration property improves still more remarkably.

The term "grain size" herein used means the grain size at ordinary temperatures.

For production of the anti-vibration steel sheet according to the present invention, firstly it is required that the steel sheet itself is soft and has good workability. For this purpose the carbon content must be not more than 0.1% and the manganese content must be not more than 0.5%.

In the present invention any other alloying elements are not added in principle, and addition of Al, Cr, etc. in a large amount is not desirable because these elements surpress the grain growth which is essential in the method according to the present invention.

In order to obtain satisfactory anti-vibration property, it is necessary, as mentioned above, to control the $\alpha$ value (yield point $\times$ grain size number) at 55 or lower.

For this purpose, in case of a hot rolled steel sheet, a steel of the above composition is not rolled and given not more than 10% strain, and annealed. In this case, the condition of the strain application is a one of the most important factors which control the $\alpha$ value and with a strain more than 10% it is impossible to maintain the $\alpha$ value at 55 or below even when the annealing condition is changed in a wide range.

Regarding the annealing after the strain has given, when the annealing temperature is lower than the recrystallization temperature the grains do not grow fully and thus the anti-vibration property is not improved.

On the other hand, when the annealing temperature is higher than the transformation point, not only the grains do not grow, but also coarse pearlite appears so that no satisfactory anti-vibration property is obtained.

Regarding the annealing time, it must be not shorter than 1 minute in order to assume satisfactory grain growth and to lower the yield point. In case where a thinner gauge of steel sheet having a high degree of dimensional accuracy and an excellent surface condition is to be produced, a steel of the above mentioned composition is hot rolled and subjected to an ordinary cold rolling, and subsequently subjected to the first step of annealing when the steel is annealed at a temperature not lower than the recrystallization temperature in order to assure an $\alpha$ value of not more than 55 in the first product. The recrystallization temperature used here means a temperature at which the initial recrystallized grains appear. Also if the annealing is done at temperatures higher than the $A_3$ transformation point, coarse pearlite is produced which hinders improvement of the anti-vibration property. Therefore, the annealing temperature should be not higher than the $A_3$ transformation point. Also, the annealing time must be not shorter than 40 seconds.

After the first step of annealing, the steel sheet is given strain of not more than 10% and again annealed. The amount of the strain given is an important factor which controls the $\alpha$ value, and with a strain larger than 10%, it is impossible to satisfy the required $\alpha$ value even when the final annealing condition is changed widely. In this second annealing, if the annealing temperature is below the recrystallization temperature, enough grain growth cannot be obtained, and, on the other hand, if the annealing temperature is higher than the $A_3$ transformation point, the final product has irregular grain sizes or susceptible to formation of pearlite so that the anti-vibration property is not improved. Regarding the annealing time, 40 seconds or long time is required for developing satisfactory grain growth and lowering the yield point.

The following production method is most preferred for practice of the present invention.

The molten steel is degassed to reduce the carbon content to 0.01% or lower by vacuum degassing. In case of a hot rolled steel strip the hot rolled strip is coiled at a temperature not higher than 680° C, more desirably not higher than 550° C, and after the hot rolling a strain ranging from 3 to 10% is given to the steel strip at a temperature not higher than 300° C, and then annealing is done at a temperature between 670° C and 710° C (inclusive) for a time not shorter than 10 minutes. In case of a cold rolled steel strip, it is desirable that the coiling after the hot rolling is done at a temperature not higher than 680° C, more desirably not higher than 550° C, the first annealing is done between 650° and 750° C (inclusive), 3 to 10% strain is given to the steel strip, and the second annealing is done between 670 and 710° C (inclusive) for 10 minutes or longer or between 800° and 850° C (inclusive) for one minute or longer.

It is still more desirable and advantageous to perform the first annealing and the subsequent strain application successively in a continuous annealing treatment line in which a continuous annealing furnace and a strain application equipment such as a temper rolling mill, a leveller and a stretcher arranged in tandem.

The desired results of the present invention can be obtained only when the all of the essential features of the present invention are satisfied and, the result of the present invention is a synergic effect of the features in combination.

The present invention has an advantage that the desired properties of the steel sheet according to the present invention are not damaged by dip-plating or electroplating such as of zinc and aluminum, but these platings are favourable because they improve the weather resistance.

Further, in the present invention a temper rolling of not more than 2% may be done at the last of the process without deviating from the scope and spirit of the present invention.

Further, the steel sheet according to the present invention relates its own anti-vibration property after it is publicated into pipes, boxes and other complicated structures by cold rolling and welding.

The present invention is applicable to various shapes and forms of the steel products, such as section steels, pipes, bars, wires, etc. as well as the steel sheet or strip.

DESCRIPTION OF THE PREFERRED EMBODIMENTS

The present invention will be more clearly understood from the following description of preferred embodiments.

EXAMPLE 1

A capped steel slab containing not more than 0.03% of carbon and not more than 0.22% of manganese is hot rolled and coiled at 550° C, and subjected to 4% temper rolling, further then annealed at 700° C for 30 minutes, and slowly cooled. The resultant steel sheet shows the $\alpha$ value of 5.76.

As a comparison, a similar steel slab is hot rolled and coiled similarly, but immediately after the coiling, annealed at 700° C for 30 minutes. The resultant steel sheet shows the $\alpha$ value of 240.6.

The anti-vibration properties of these steel sheets are remarkably different as shown in Table 1, and it is clear that the steel sheet according to the present invention has far better anti-vibration property.

EXAMPLE 2

An ordinary capped steel slab containing not more than 0.06% of carbon, not more than 0.25% of manganese is hot rolled, coiled at 550° C, cold rolled with 70% reduction, annealed at 700° C for one minute and temper rolled with 4% reduction in a continuous annealing line in which an annealing furnace and a temper rolling mill are arranged in tandem, and subsequently annealed at 700° C for 30 minutes, and slowly cooled. The resultant steel sheet shows the $\alpha$ value of 11.76.

For comparison, a similar capped steel slab hot rolled and cold rolled similarly, but annealed at 700° C for 30 minutes immediately after the cold rolling. The resultant steel sheet shows the $\alpha$ value of 378.1.

The anti-vibration properties of these steel sheets are remarkably different as shown in Table 2 and it is clear that the steel sheet according to the present invention has far better anti-vibration property.

It should be understood that the present invention is limited to the above embodiments but may be modified without deviating from the scope and spirit of the present invention.

For example, the annealing, first and second annealing steps described hereinbefore, may be carried out in a continuous type or in a batch type. However particularly the annealing step is preferably carried out in a batch type for a time not longer than 60 hours.

Regarding the strain application, it may be given by temper rolling, levelling or stretching, for example.

Table 1

| Samples | Yield Point: $\sigma_y$ (kg/mm²) | Grain Size Number: N | $\alpha = \sigma_y \times N$ | Logarithmic Attenuation | Sheet Thickness after Hot Rolling(mm) |
|---|---|---|---|---|---|
| Present Invention | 7.2 | 1.3 | 9.36 | 0.012 | 3.0 |
| Comparison | 28.3 | 8.5 | 240.6 | 0.004 | 3.0 |

Table 2

| Samples | Yield Point: $\sigma_y$ (kg/mm²) | Grain Size Number: N | $\alpha = \sigma_y \times N$ | Logarithmic Attenuation | Sheet Thickness after Cold Rolling (mm) |
|---|---|---|---|---|---|
| Present Invention | 9.8 | 1.2 | 11.76 | 0.011 | 0.8 |
| Comparison | 31.2 | 9.6 | 378.1 | 0.003 | 0.8 |

What is claimed:

1. An anti-vibration steel material containing not more than 0.1% of carbon, not more than 0.5% manganese and unavoidable impurities with the balance being iron having a logarithmic attenuation of not less than 0.006 when given vibration of 0.01% of surfacial strain, and not lower than 55 ot $\alpha$ value defined below $$\alpha = \sigma_y \times N$$

where $\sigma_y$ is yield point or stress (kg/mm²) at 0.2% strain

N is grain size number and $N =$

-continued $$1 + \frac{1}{0.301} \log\left\{500\left(\frac{M}{100}\right)^2 \left(\frac{n_1 \times n_2}{L_1 \times L_2}\right)\right\}$$

in which

M is observation magnification.

$L_1$ ($L_2$) is the total (mm) of lengths of line components in one direction of line components crossing each other at right angle.

$n_1$ ($n_2$) is the total number of the grains cut by $L_1$ ($L_2$).

2. A method for producing an anti-vibration steel material which comprises hot rolling a steel slab, billet or bloom containing not more than 0.1% of carbon, not more than 0.5% of manganese, giving not more than 10% of strain to the hot rolled steel, annealing the hot rolled steel thus strain given at a temperature not lower than its recrystallization temperature but not higher than its $A_3$ transformation point for at least one minute and controlling the $\alpha$ value as defined herein to a value not more than 55.

3. A method for producing an anti-vibration steel material which comprises hot rolling a steel slab containing not more than 0.1% of carbon, not more than 0.5% of manganese, cold rolling the hot rolled steel, annealing the cold rolled steel at a temperature not lower than its recrystallization temperature but not higher than its $A_3$ transformation point for a time not shorter than 40 seconds, giving the steel thus annealed not more than 10% of strain, annealing the steel thus strain given at a temperature not lower than its recrystallization temperature but not higher than its $A_3$ transformation point for a time not shorter than 40 seconds and controlling the $\alpha$ value as defined herein to a value not more than 55.

4. A method according to claim 2 in which the steel slab, billet or bloom is made from a vacuum degassed steel containing not more than 0.01% of carbon.

5. A method according to claim 3 in which the steel slab is made from a vacuum degassed steel containing not more than 0.01% of carbon.

6. A method according to claim 2 in which the hot rolled steel is coiled at a temperature not higher than 680° C, and 3 to 10% of strain is given to the hot rolled steel at a temperature not higher than 300° C, and the annealing is done at a temperature between 670° and 710° C (inclusive) for a time not shorter than 10 minutes.

7. A method according to claim 3 in which the hot rolled steel is coiled at a temperature not higher than 550° C and annealed at a temperature not lower than 650° C but not higher than 750° C, the strain given to the steel is 3 to 10% at a temperature not higher than 300° C, and the annealing after the strain is given is done at a temperature not lower than 670° C but not higher than 710° C for a time not shorter than 10 minutes.

* * * * *